US010278240B2

(12) United States Patent
Ham et al.

(10) Patent No.: US 10,278,240 B2
(45) Date of Patent: Apr. 30, 2019

(54) COOKING APPLIANCE

(71) Applicant: Samsung Electronics Co., Ltd., Suwon-si (KR)

(72) Inventors: Hyung Kwen Ham, Seoul (KR); Nam Soo Park, Suwon-si (KR); Jea Won Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 399 days.

(21) Appl. No.: 15/180,375

(22) Filed: Jun. 13, 2016

(65) Prior Publication Data

US 2016/0374157 A1 Dec. 22, 2016

(30) Foreign Application Priority Data

Jun. 19, 2015 (KR) ..... 10-2015-0087629

(51) Int. Cl.
*H05B 6/76* (2006.01)
*H05B 6/64* (2006.01)

(52) U.S. Cl.
CPC ..... *H05B 6/6414* (2013.01)

(58) Field of Classification Search
CPC .... H05B 6/6414; H05B 6/6417; H05B 6/666; H05B 6/763; H05B 6/766
USPC ..... 219/723, 724, 739; 126/190, 192, 194, 126/198
See application file for complete search history.

(56) References Cited

U.S. PATENT DOCUMENTS 2,800,128 A * 7/1957 Chesser ..... F24C 15/023 126/194
4,138,988 A 2/1979 Hurley
5,822,925 A * 10/1998 McKinney ..... F23M 7/00 126/194
2009/0321430 A1 12/2009 Jeong

FOREIGN PATENT DOCUMENTS

JP 2001-299478 10/2001
KR 10-2002-0050024 6/2002
KR 10-2006-0093864 8/2006
KR 10-2009-0112976 10/2009
(Continued)

OTHER PUBLICATIONS

Extended European Search Report dated May 14, 2018 in European Patent Application No. 16811914.7.
(Continued)

*Primary Examiner* — Hung D Nguyen
(74) *Attorney, Agent, or Firm* — Staas & Halsey LLP

(57) ABSTRACT

A cooking appliance including a body includes a cooking compartment and an electrical component compartment formed therein, a door link-coupled with the body to open and/or close the cooking compartment, a door moving unit including a link member which connects the door with the body to allow the door to pivot upward and downward in front of the cooking compartment, and a cover unit which prevents the electrical component compartment in the body from being exposed by a movement of the link member. Here, the body includes a link moving portion formed on a front side to allow the link member to move into or out of the body, and the cover unit is configured to shield the link moving portion when the door is opened.

18 Claims, 12 Drawing Sheets

(56) References Cited

FOREIGN PATENT DOCUMENTS

| | | |
|---|---|---|
| KR | 10-2010-0000624 | 1/2010 |
| KR | 10-1492094 | 2/2015 |
| WO | WO86/04978 | 8/1986 |

OTHER PUBLICATIONS

International Search Report dated Oct. 12, 2016 in International Patent Application No. PCT/KR2016/006330.
Chinese Office Action dated Jan. 2, 2019 in Chinese Patent Application No. 201680035884.1.
European Communication under Rule 71(3) dated Mar. 1, 2019 in European Patent Application No. 16811914.7.

* cited by examiner

COOKING APPLIANCE

CROSS-REFERENCE TO RELATED APPLICATIONS

This application claims the priority benefit of Korean Patent Application No. 10-2015-0087629, filed on Jun. 19, 2015 in the Korean Intellectual Property Office, the disclosure of which is incorporated herein by reference.

BACKGROUND

1. Field

The following description relates to a cooking appliance with an improved structure for allowing a door that opens and/or closes a cooking compartment to be moved upward and downward.

2. Description of the Related Art

Microwave ovens are cooking appliances which heat food using properties of electromagnetic waves called microwaves. Microwave ovens generate heat inside of food and heat the food using a dielectric heating method.

Generally, cooking appliances including microwave ovens are configured to allow one side of a door which opens and/or closes a cooking compartment to be hinge-coupled with a body and capable of pivoting. Accordingly, the door of the cooking compartment pivots about the one side coupled with the body and opens and/or closes the cooking compartment. Because a pivoting radius of the door in such a configuration becomes larger depending on a size of the door, it is difficult to use the door in a small space.

Also, cooking appliances with a structure in which a door is moved upward and downward to open and/or close a cooking compartment has a limitation in which an inside of a body is exposed when the door is moved upward and downward.

SUMMARY

Therefore, it is an aspect of the present disclosure to provide a cooking appliance with an improved structure capable of reducing a moving radius of a door when the door opens and/or closes.

Also, it is an aspect of the present disclosure to provide a cooking appliance with an improved structure which allows a door to open and/or close a cooking compartment while the door is moved upward and downward.

Also, it is an aspect of the present disclosure to provide a cooking appliance with an improved structure capable of preventing internal components of the cooking appliance from being exposed when a door opens and/or closes a cooking compartment.

Additional aspects of the present disclosure will be set forth in part in the description which follows and, in part, will be obvious from the description, or may be learned by practice of the present disclosure.

In accordance with an aspect of the present disclosure, a cooking appliance includes a body in which a cooking compartment and an electrical component compartment are formed. a door link-coupled with the body to open and/or close the cooking compartment, a door moving unit including a link member which connects the door with the body to allow the door to pivot upward and downward in front of the cooking compartment, and a cover unit which prevents the electrical component compartment in the body from being exposed by a movement of the link member. Here, the body includes a link moving portion formed on a front side to allow the link member to move into or out of the body, and the cover unit is configured to shield the link moving portion when the door is opened.

The cover unit may include a cover plate provided to open and/or close the link moving portion and a first elastic member which transfers an elastic force to allow the cover plate to move toward the link moving portion, and the cover plate may be configured to allow one side to be in contact with a rear side of the link member and to shield the link moving portion when the link member is moved outside of the body.

The link member may include a fixing portion in contact with a rear side of the cover plate to allow the cover plate to be fixed while shielding the link moving portion.

The cover plate may be pivotably coupled with one side of the front side of the body, and the first elastic member may be configured to transfer the elastic force in a direction in which the cover plate pivots toward the link moving portion.

The cover plate may be moved together with the link member toward a front of the cooking appliance to shield the link moving portion when the door is opened and/or is moved with the link member toward a rear of the cooking appliance when the door is closed.

The link member may include a first link member coupled with one side of the door and a second link member coupled with the other side of the door, and the first link member and the second link member may be installed at symmetrical positions with respect to the cooking compartment in the electrical component compartment.

The link moving portion may include a first link moving portion in which the first link portion is moved and a second link moving portion in which the second link member is moved, and the cover unit may include a first cover unit which shields the first link moving portion and a second cover unit which shields the second link moving portion.

The link member may further include a first holding portion formed on one side. Here, the door moving unit may further include a second elastic member which connects the first holding portion with a second holding portion formed in the rear of the first holding portion, and the first holding portion may be formed to pivot around a pivoting shaft of the link member.

When the door is opened, the first holding portion may be moved to a position higher than the second holding portion which is fixed, and the second elastic member may be provided to transfer the elastic force to the link member in a direction in which the door is moved upward.

The link member may include a third link member coupled with the one side of the door with the first link member, a fourth link member coupled with the other side of the door with the second link member, a fifth link member which connects the first link member with the third link member to pivot together, and a sixth link member which connects the second link member with the fourth link member to pivot together.

The door moving unit may further include a connecting member which connects the first link member with the second link member to allow the first link member and the second link member to pivot at the same angle.

In accordance with an aspect of the present disclosure, a cooking appliance includes a body including a cooking compartment formed therein, a door coupled with the body to open and/or close the cooking compartment, a door moving unit which connects the door with the body to allow the door to pivot with respect to the body, and a cover unit which prevents an inside of the body from being exposed by a movement of a link member. Here, the body includes a link moving portion formed on one side of the body to allow the door moving unit to move into or out of the body, and the cover unit is configured to shield the link moving portion when the door is opened.

The door moving portion may be configured to allow the door to pivot upward and downward in front of the cooking compartment.

The cover unit may include a cover plate provided to open and/or close the link moving portion and a first elastic member which transfers an elastic force to allow the cover plate to move toward the link moving portion, and the cover plate may be configured to be installed in the rear of the door moving unit and to shield the link moving portion when the door moving unit is moved outside the body.

The door moving unit may include a fixing portion in contact with a rear side of the cover plate to allow the cover plate to be fixed while shielding the link moving portion.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
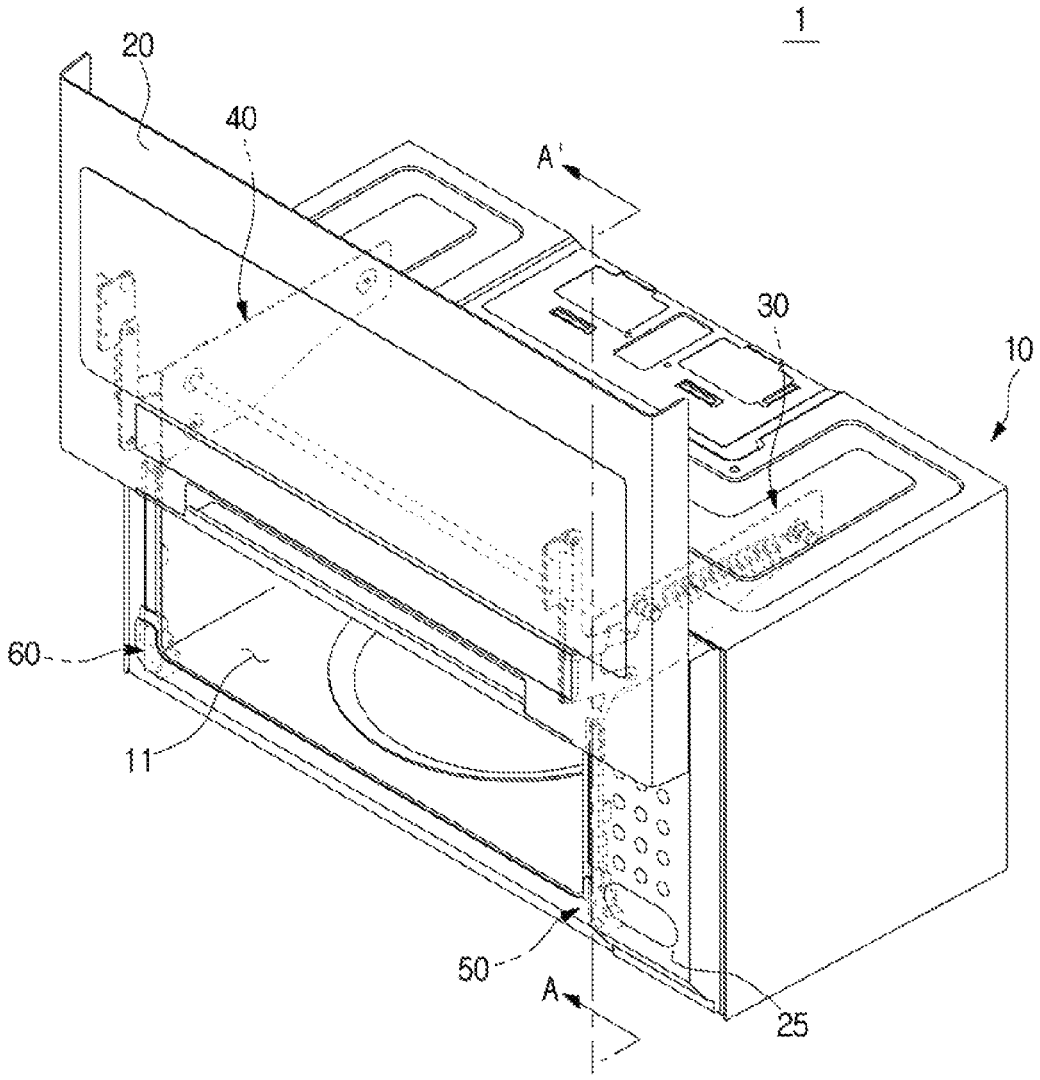
FIG. 1 is a perspective view of a cooking appliance in accordance with an embodiment of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Hereinafter, a cooking appliance in accordance with an embodiment of the present disclosure will be described in detail with reference to the attached drawings.

The cooking appliance in accordance with the embodiment may be applied to all cooking appliance which cook foods using at least one of microwaves, radiant heat by a heater, and convection heat. In detail, such cooking appliances include microwave ovens, electric ovens, and complex ovens. Hereinafter, for convenience of description, a microwave oven will be described as an example of the cooking appliance.

Figure 2:
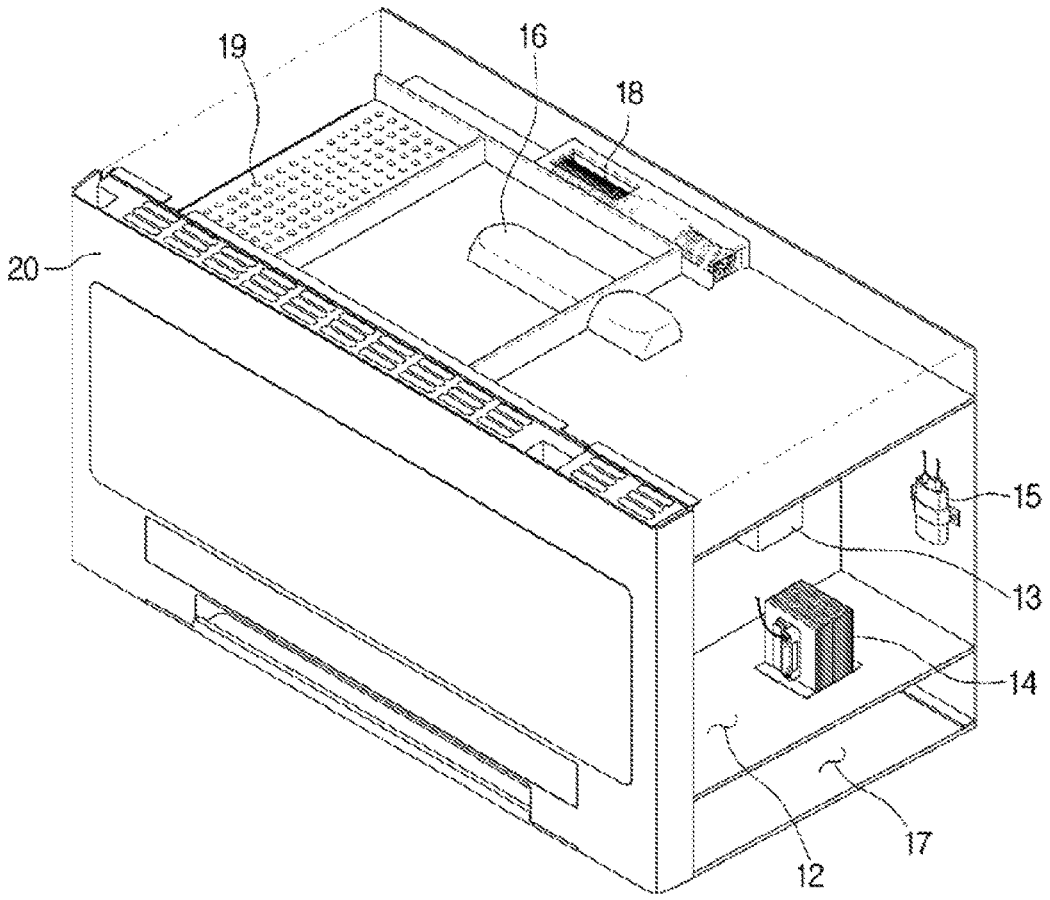
FIG. 2 is a view illustrating components of an electrical component compartment of the cooking appliance of FIG. 1.

FIG. 1 is a perspective view of a cooking appliance in accordance with an embodiment of the present disclosure. FIG. 2 is a configuration diagram of an electrical component compartment of the cooking appliance of FIG. 1.

Referring to FIGS. 1 and 2, a cooking appliance 1 in accordance with an embodiment of the present disclosure includes a body 10 with a cooking compartment 11 and an electrical component compartment 12 formed therein and a door 20 which opens and/or closes the cooking compartment 11.

An inside of the body 10 may be divided into the cooking compartment 11 and the electrical component compartment 12 with various electrical components installed therein. The cooking compartment 11 has an open front to allow food to be put in or taken out, and the door 20 capable of opening and/or closing the cooking compartment 11 may be installed in front of the cooking compartment 11. Meanwhile, the electrical component compartment 12 may accommodate electrical components such as a magnetron 13, a high-voltage transformer 14 for applying a high voltage to the magnetron 13, and a high-voltage condenser 15. A high-frequency wave generated by the magnetron 13 may be guided into the cooking compartment 11 by a guide duct 16 installed on top of the cooking compartment 11.

A cooking apparatus (not shown) including an oven, etc. may be additionally installed below the cooking appliance 1 of FIG. 1. A discharge flow channel 17 and an air blowing fan 18 for discharging air polluted by steam and smoke generated while the cooking apparatus is being used may be installed in the body 10. The discharge flow channel 17 has a structure which enters a bottom of the body 10 and passes to a top of the body 10. The air blowing fan 18 may be installed at an upper rear portion of the body 10. In addition, a flue hole 19 may be provided at the top of the body 10 to discharge smoke and odors which are generated in the cooking compartment 11 to the outside. On the contrary, the cooking appliance 1 may be provided without the cooking apparatus described above.

A control panel 25 which controls various components of a microwave oven may be installed on a right front side of the body 10.

Figure 3:
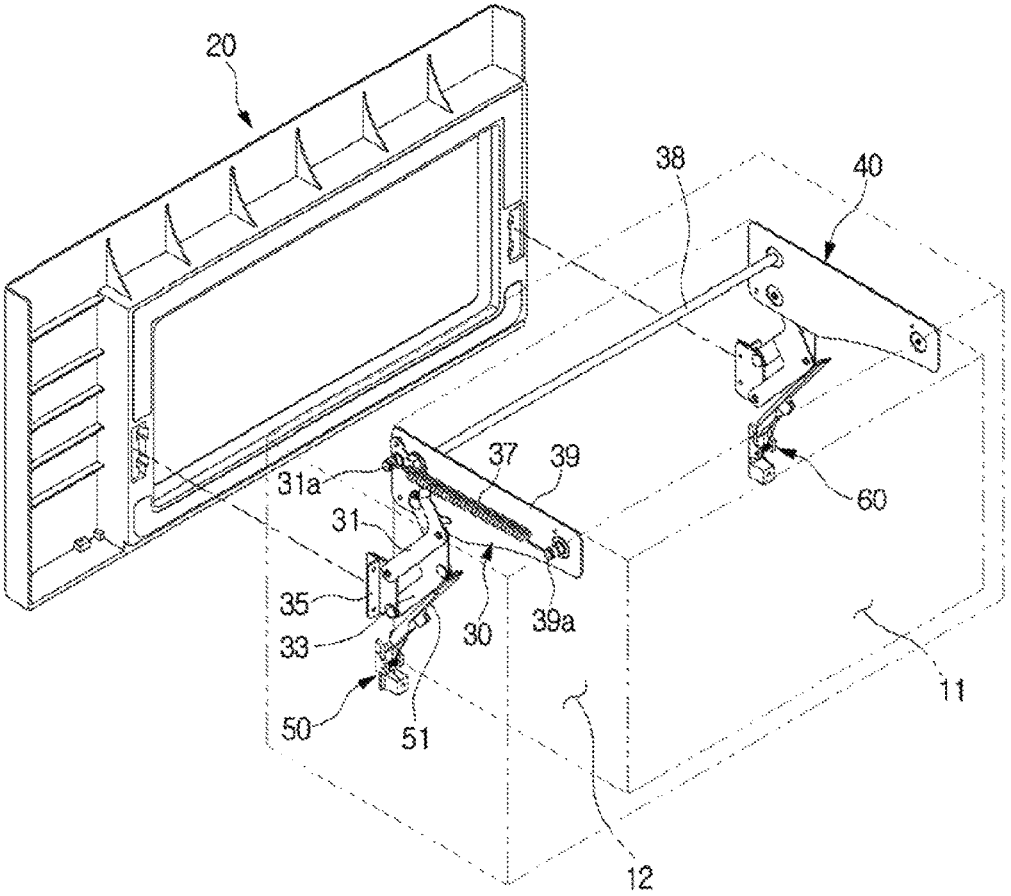
FIG. 3 is a view illustrating components of a door moving unit and a cover unit in the cooking appliance of FIG. 1.
Figure 4:
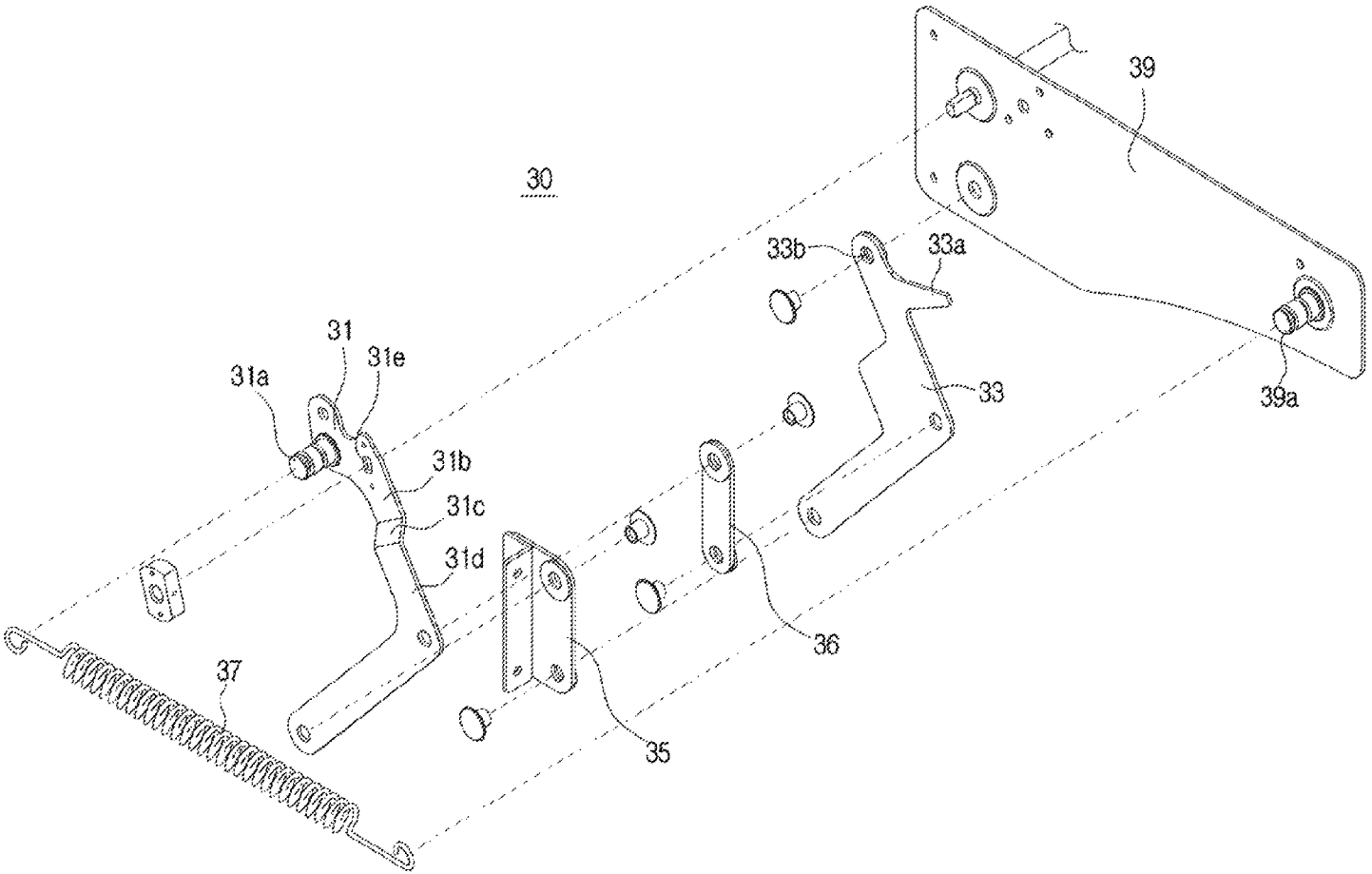
FIG. 4 is an exploded perspective view illustrating a coupling relation for the door moving unit of FIG. 3.
Figure 5:
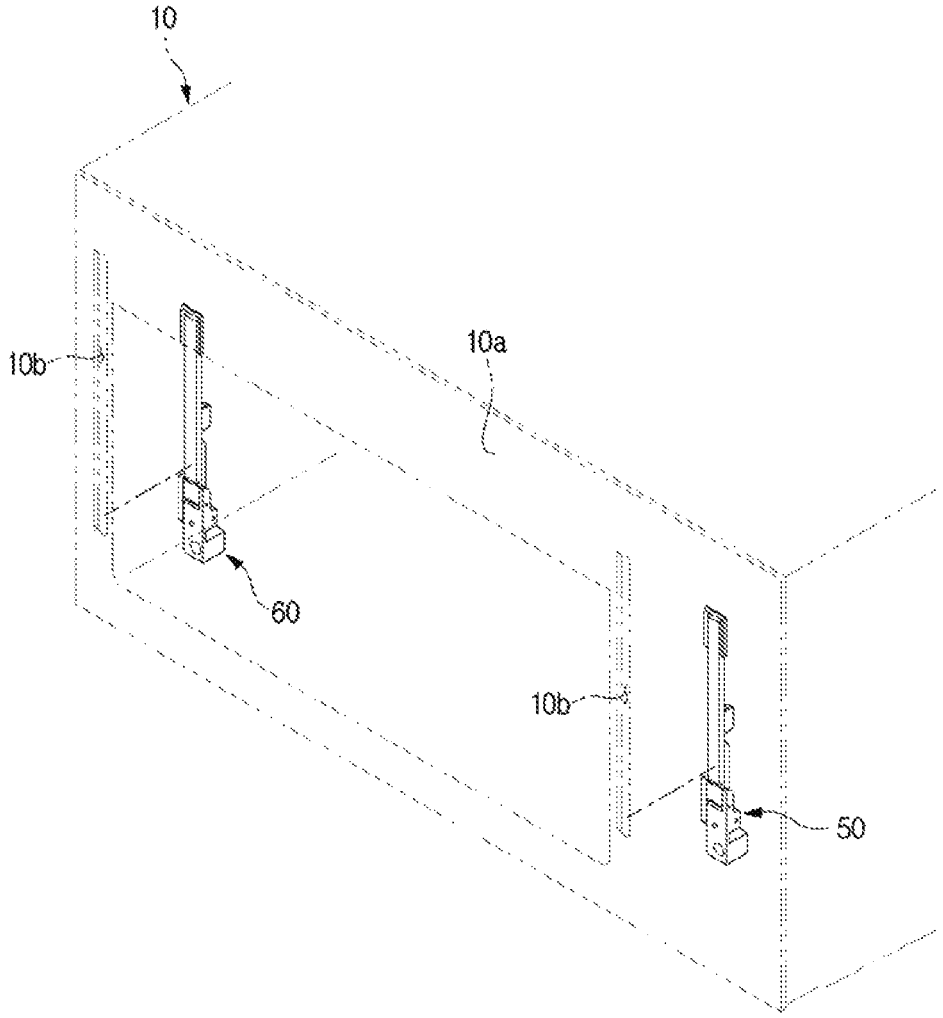
FIG. 5 is a view illustrating a position at which the cover unit of FIG. 3 is coupled with a body.
Figure 6:
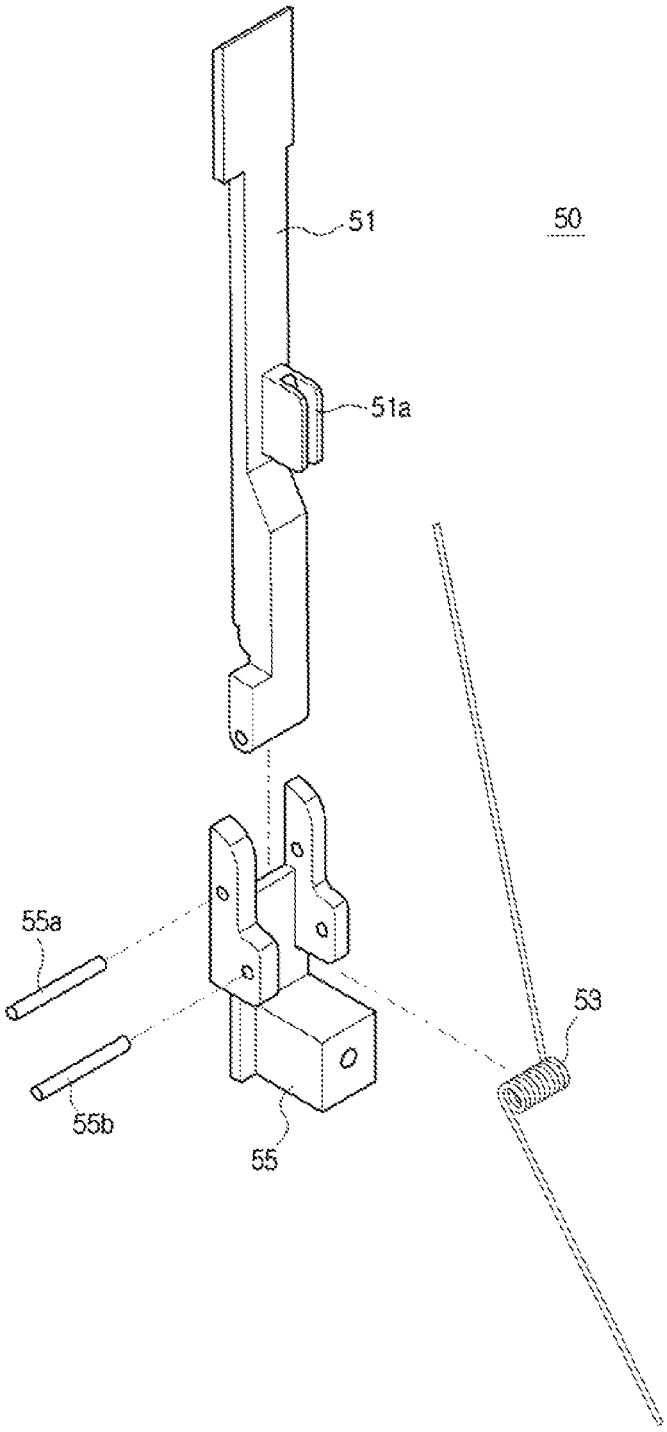
FIG. 6 is an exploded perspective view illustrating a coupling relation for the cover unit of FIG. 3.

FIG. 3 is a view illustrating components of a door moving unit, or door moving connector, and a cover unit, or cover, in the cooking appliance of FIG. 1. FIG. 4 is an exploded perspective view illustrating a coupling relation for the door moving unit of FIG. 3. FIG. 5 is a view illustrating a position at which the cover unit of FIG. 3 is coupled with the body. FIG. 6 is an exploded perspective view illustrating a coupling relation for the cover unit of FIG. 3.

Referring to FIGS. 1 to 6, the cooking appliance 1 may further include door moving units 30 and 40 which move the door 20.

The door moving units 30 and 40 may be configured to move the door 20 with respect to the body 10. The door moving units 30 and 40 may be coupled with the body 10 to move the door 20 upward and downward. The door moving units 30 and 40 may be provided to open and/or close the cooking compartment 11 by having the door 20 move upward and downward.

The door moving units 30 and 40 may be provided as a pair of door moving units 30 and 40 to be coupled with both sides of the door 20 which is moved upward and downward. The pair of door moving units 30 and 40 may be provided to be coupled with both sides of the door 20 and pivot upward and downward with respect to the body 10. The pair of door moving units 30 and 40 may be disposed on both sides of the cooking compartment 11 to be symmetrical. The pair of door moving units 30 and 40 may be provided to be coupled with both sides of the door 20 and to prevent rocking of the door 20 while the door 20 is being moved.

The door moving units 30 and 40 may be configured to pivot with respect to the body 10. The door moving units 30 and 40 may be configured to be linked with the inside of the body 10 and pivot. A link moving portion, or link moving opening, 10*b* may be formed on a front side 10*a* of the body 10 to be moved into or out of the body 10. The link moving portion 10*b* may be formed at a position corresponding to each of the pair of door moving units 30 and 40 to allow the pair of door moving units 30 and 40 to move into or out of the body 10. The link moving portion 10*b* may be provided in a slit shape on the front side 10*a* of the body 10.

Hereinafter, a detailed configuration of the door moving units 30 and 40 will be described. The pair of door moving units 30 and 40 may include the same components. The door moving unit 30 installed on one side of the pair of door moving units 30 and 40 may have the same components as those of the door moving unit 40 installed on the other side. Hereinafter, for convenience of description, the door moving unit 30 installed on one side of the pair of door moving units 30 and 40 will be described as an example.

The door moving unit 30 may include link members 31, 33, 35, and 36 which connect the door 20 with the body 10. The link members 31, 33, 35, and 36 may connect the door 20 with the body 10 to allow the door 20 to be movable upward and downward with respect to the body 10. The link members 31, 33, 35, and 36 may be installed at a fixing plate 39 installed on an inner surface of the body 10.

The link members may include a first link member 31. One side 31*d* of the first link member 31 may be coupled with the door 20 and another side 31*b* thereof may be coupled with the body 10. The first link member 31 may be formed in a shape of being bent from the one side 31*d* coupled with the door 20 and extending to the other side 31*b* coupled with the body 10. The first link member 31 may include a control portion 31*c* to prevent a collision with a third link member 33 which will be described below. The control portion 31*c* may have a bent shape to allow a part of the first link member 31 overlapping with the third link member 33 to be separated from the third link member 33.

The first link member 31 may be coupled to allow a part 31*e* coupled with the body 10 to be pivotable. The first link member 31 may be configured to pivot around the part 31*e* coupled with the body 10. The first link member 31 may pivot around the part 31*e* coupled with the body 10 to allow the door 20 to pivot.

The link members may include a third link member 33. The third link member 33 may connect the door 20 with the body 10 on the same side. The third link member 33 may be formed in a shape having one side connected with the door 20 and one side bent and connected with the body 10.

The third link member 33 may be coupled to be pivotable with respect to the body 10. One side 33*b* of the third link member 33 may be pivotably coupled with the fixing plate 39. The third link member 33 may be configured to pivot around the one side 33*b* fixed to the fixing plate 39. The one side 33*b*, that is, a pivoting shaft of the third link member 33 may be installed below the part 31*e*, that is, a pivoting shaft of the first link member 31.

The third link member 33 may pivot together with the first link member 31 to allow the door 20 to pivot. The third link member 33 may be coupled with the door 20 below a position at which the first link member 31 is coupled with the door 20. The door 20 may be coupled with the first link member 31 at a height different from that of the third link member 33. Due to this, the door 20 may be prevented from rocking while pivoting upward and downward.

As described above, due to the control portion 31*c*, the first link member 31 may be separated from the third link member 33 by a predetermined distance. Due to this, the first link member 31 and the third link member 33 may be configured not to collide with each other even when pivoting together.

The link members may include a fifth link member 35. The fifth link member 35 may connect the first link member 31 with the third link member 33. One side of the fifth link member 35 may be coupled with the door 20, and the other side may be coupled with the first link member 31 and the third link member 33. The fifth link member 35 may be coupled with the first link member 31 and the third link member 33 at different heights. The fifth link member 35 may be configured to allow the first link member 31 and the third link member 33 to pivot at the same time.

The link members may include a seventh link member 36. The seventh link member 36 may connect the first link member 31 with the third link member 33. The seventh link member 36 may be connected to each central portion of the first link member 31 and the third link member 33. The seventh link member 36 and the fifth link member 35 may be configured to allow the first link member 31 and the third link member 33 to pivot at the same time.

The link members may further include a fixing portion 33*a* which fixes positions of cover units 50 and 60. Although the fixing portion 33*a* is shown as formed on one side of the third link 33, the fixing portion 33*a* may be installed at the first link member 31 to be in contact with rear sides of the cover units 50 and 60. The fixing portion 33*a* will be described below in detail together with the cover units 50 and 60.

The door moving unit 30 may further include a second elastic member 37. The second elastic member 37 may connect the link member with the body 10 and may generate an elastic force according to a position of the link member. The second elastic member 37 may transfer the elastic force to the door 20 to allow the door 20 to easily pivot. Also, the second elastic member 37 may be configured to transfer the elastic force that balances a weight of the door 20 to allow the door 20 to stop at a particular position.

The second elastic member 37 may be coupled with a first holding portion 31*a* formed at the first link member 31 and a second holding portion 39*a* formed on one side of the body 10. The first holding portion 31*a* may be installed in front of the second holding portion 39*a*. The second holding portion 39*a* may be formed at the fixing plate 39 in the rear of the first holding portion 31*a*. The first holding portion 31*a* may be installed at a position adjacent to the part 31*e*, that is, the pivoting shaft of the first link member 31. Due to this, the first holding portion 31*a* may be configured to pivot around the part 31*e*, that is, the pivoting shaft of the first link member 31. The first holding portion 31*a* may be configured to pivot around the part 31*e*, that is, the pivoting shaft of the first link member 31 and to allow a relative position with respect to the second holding portion 39*a* to be moved. The second elastic member 37 may be provided in such a way that the relative position of the first holding portion 31*a* with respect to the second holding portion 39*a* may be moved and a direction of the elastic force provided to the door 20 may be changed. The second holding portion 39*a* may be installed at a fixed position.

The door moving unit 40 disposed beside the other side of the door moving unit 30 may include a second link member (not shown), a fourth link member (not shown), a sixth link member (not shown), an eighth link member (not shown), and a fourth elastic member (not shown). The second link member, the fourth link member, the sixth link member, the eighth link member, and the fourth elastic member, as described above, correspond to the first link member 31, the third link member 33, the fifth link member 35, the seventh link member 36, and the second elastic member 37. Accordingly, a description thereof will be omitted.

The door moving units 30 and 40 may further include a connecting member 38 which connects the first link member 31 with the second link member to allow the first link member 31 and the second link member to pivot at the same angle.

The cooking appliance 1 may further include the cover units 50 and 60 which prevents the inside of the body 10 from being exposed. The cover units 50 and 60 may prevent the inside of the body 10 from being exposed by the link moving portion 10*b* due to movements of the door moving units 30 and 40. The cover units 50 and 60 may be configured to shield the link moving portion 10*b* when the door 20 is being opened.

The cover units 50 and 60 may be configured to be coupled with the link moving portions 10*b* formed to correspond to the pair of door moving units 30 and 40. The cover units 50 and 60 may be configured to be coupled with the link moving portions 10*b* formed to correspond to the pair of door moving units 30 and 40. A first cover unit 50 of a pair of such cover units 50 and 60 installed on one side may have the same configuration of a second cover unit 60 installed on another side. The pair of cover units 50 and 60 may be installed at symmetrical positions with respect to the cooking compartment 11. Hereinafter, for convenience of description, of the pair of cover units 50 and 60, the cover unit 50 installed on the one side will be described as an example.

The first cover unit 50 may include a cover plate 51 and a first elastic member 53.

The cover plate 51 may be provided to open and/or close the link moving portion 10*b*. The cover plate 51 may have a shape corresponding to the link moving portion 10*b* to shield the link moving portion 10*b*. The cover plate 51 may be configured to allow one side to be in contact with a rear side of the third link member 33 and to shield the link moving portion 10*b* when the third link member 33 moves outside of the body 10. The cover plate 51 may be moved toward the front of the cooking appliance 1 with the third link member 33 when the door 20 is opened to shield the link moving portion 10*b* and may be moved toward the rear of the cooking appliance 1 together with the third link member 33 when the door 20 is closed.

The cover plate 51 may be pivotably coupled with one side of the front side 10*a* of the body 10. The cover plate 51 may open and/or close the link moving portion 10*b* while pivoting around the one side of the front side 10*a* of the body 10. The cover plate 51 may pivot according to a movement of the third link member 33 while being in contact with one side of the rear side of the third link member 33.

The first elastic member 53 may transfer an elastic force to the cover plate 51 to allow the cover plate 51 to be movable forward. The first elastic member 53 may be provided to allow one side to be coupled with a coupling portion 51*a* formed on a rear side of the cover plate 51. The first elastic member 53 may be connected to the coupling portion 51*a* and may transfer the elastic force toward a front of the cover plate 51.

The first cover unit 50 may further include a body portion 55. The body portion 55 may be installed on one side of the front side 10*a* of the body 10. The body portion 55 may be installed at a position which allows the cover plate 51 to pivot to open or close the link moving portion 10*b*. The cover plate 51 may be pivotably coupled with one side of the body portion 55 using a pin 55*a*. The first elastic member 53 may be installed by being coupled with another side of the body portion 55 using a pin 55*b*. As described above, the cover plate 51 and the first elastic member 53 may be installed on the front side 10*a* of the body 10 through the body portion 55. The body portion 55 may optionally not be provided.

The cover plate 51 may be provided to allow the fixing portion 33*a* to be in contact with a rear side of the link moving portion 10*b* while shielding the link moving portion 10*b*. The fixing portion 33*a* may be in contact with the rear side of the cover plate 51 to fix the cover plate 51 not to move backward.

The second cover unit 60 may include a cover plate (not shown), a second elastic member (not shown), and a body portion (not shown). The cover plate, the third elastic member, and the body portion of the second cover unit 60 are components corresponding to the cover plate 51, the first elastic member 53, and the body portion 55 of the first cover unit 50. Accordingly, a description thereof will be omitted.

Hereinafter, operations of the door moving unit and the cover unit will be described through the configuration of the cooking appliance 1 described above.

Figure 7:
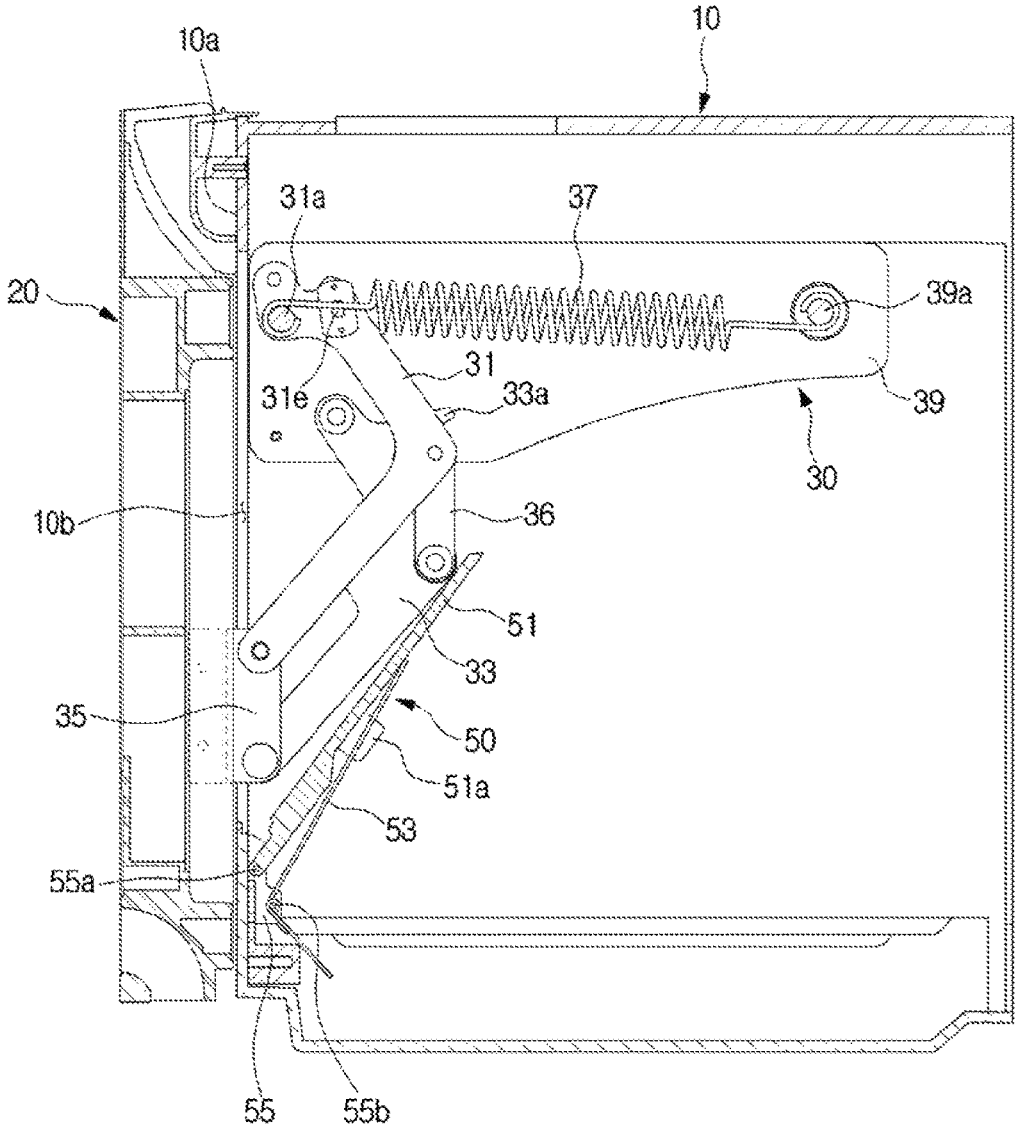
FIGS. 7, 8, and 9 are views illustrating operations of the door moving unit and the cover unit according to a movement of a door when viewed from line A-A' of FIG. 1.
Figure 8:
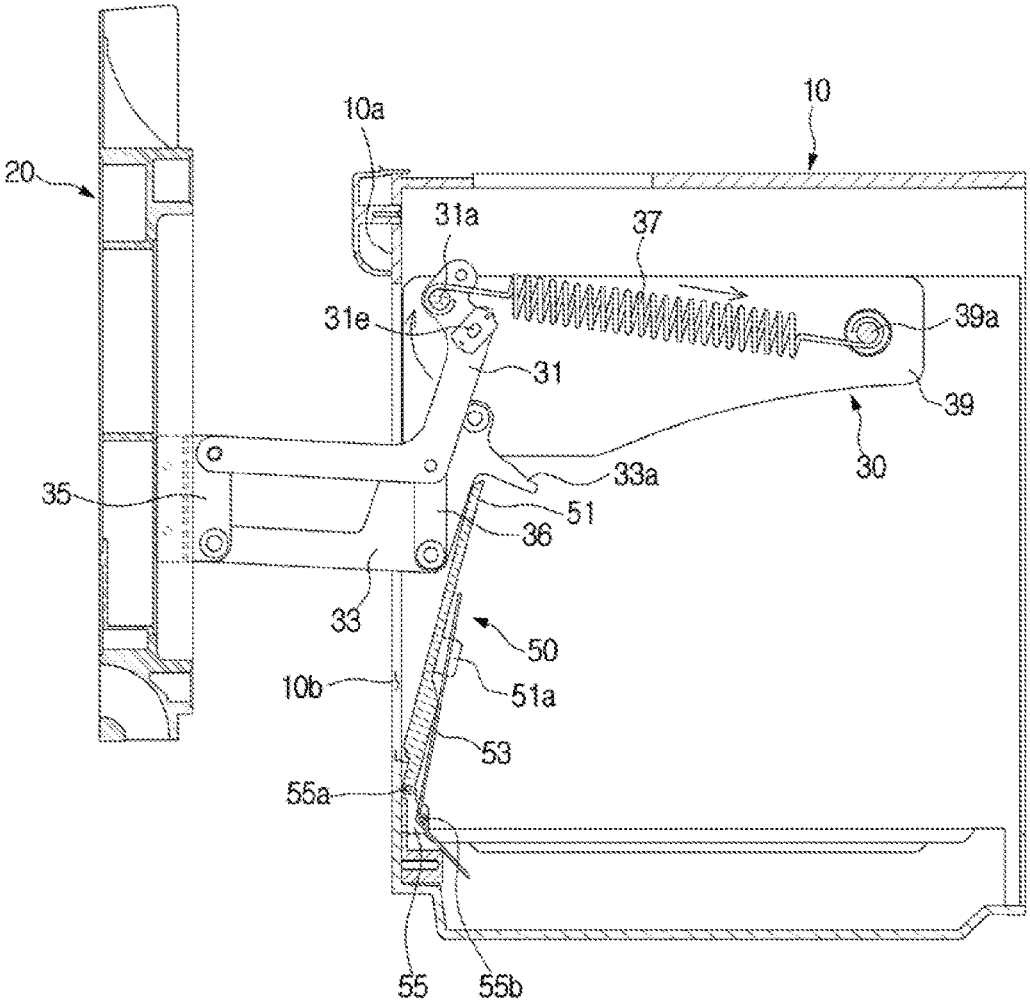
Figure 9:
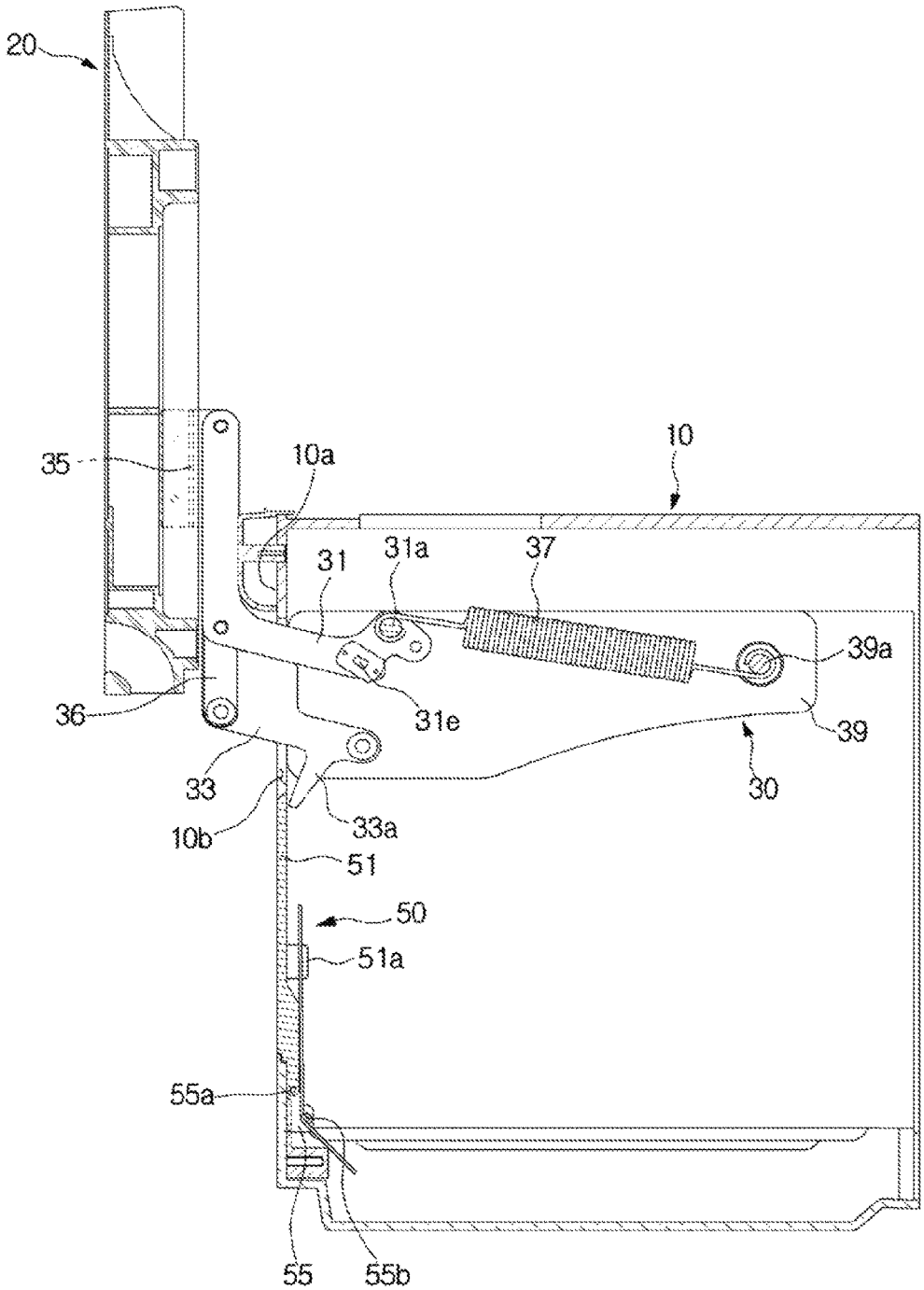

FIGS. 7 to 9 are views illustrating the operations of the door moving unit and the cover unit according to the movement of the door when viewed from line A-A' of FIG. 1.

Referring to FIGS. 7 to 9, in the cooking appliance 1 in accordance with an embodiment of the present disclosure, according to the configuration described above, the door 20 may open and/or close the cooking compartment 11 while pivoting upward and downward in front the cooking compartment 11.

As shown in FIG. 7, when the door 20 is closed, the door moving unit 30 may be positioned inside the body 10. Here, the first holding portion 31*a* with which the second elastic member 37 is connected may be disposed at a position lower than that of the part 31*e*, that is, the pivoting shaft of the first link member 31. Due to this, an elastic force of the second elastic member 37 may be transferred to the first link member 31 in a direction in which the door 20 closes. The second elastic member 37 may be configured to transfer the elastic force to the door 20 in the rear of the cooking compartment 11 while the door 20 is closed. Due to this, the door moving unit 30 may transfer the elastic force to the door 20 to allow the door 20 to keep the cooking compartment 11 closed.

As shown in FIG. 8, when a user opens the door 20, the door 20 may pivot upward with the door moving unit 30. The door 20 may be coupled with the first and third link members 31 and 33 at different heights and may pivot while remaining parallel to the front side 10*a* of the body 10. Also, rocking of the door 20 which may occur during pivoting may be prevented.

As the door moving unit 30 pivots together with the door 20, the first holding portion 31*a* with which the second elastic member 37 is connected may be moved to a position higher than the part 31*e*, that is, the pivoting shaft of the first link member 31. Due to this, the elastic force of the second elastic member 37 may be transferred to the first link member 31 in a direction in which the door 20 pivots upward. Due to this, the door moving unit 30 may transfer the elastic force to the door 20 to open in the direction in which the door 20 pivots upward to allow the door 20 to pivot upward only using a small force.

Also, as shown in FIG. 8, when the door 20 is opened, the door 20 may receive the elastic force in the direction in which the door 20 pivots upward with respect to the door moving unit 30 and may receive force in a direction in which the door 20 pivots downward due to the weight of the door 20. The door 20 may remain stopped at a position where the elastic force transferred from the door moving unit 30 is balanced with gravity, that is, the weight of the door 20 itself.

As shown in FIG. 9, when the door 20 pivots upward maximally, the front side 10*a* of the body 10 comes in contact with a rear side of the door 20, and the door 20 stops moving. Here, the door 20 may receive the elastic force from the second elastic member 37 in the direction in which the door 20 pivots upward. Due to this, the door 20 may remain open as shown in FIG. 9 unless an external force is applied.

Figure 10:
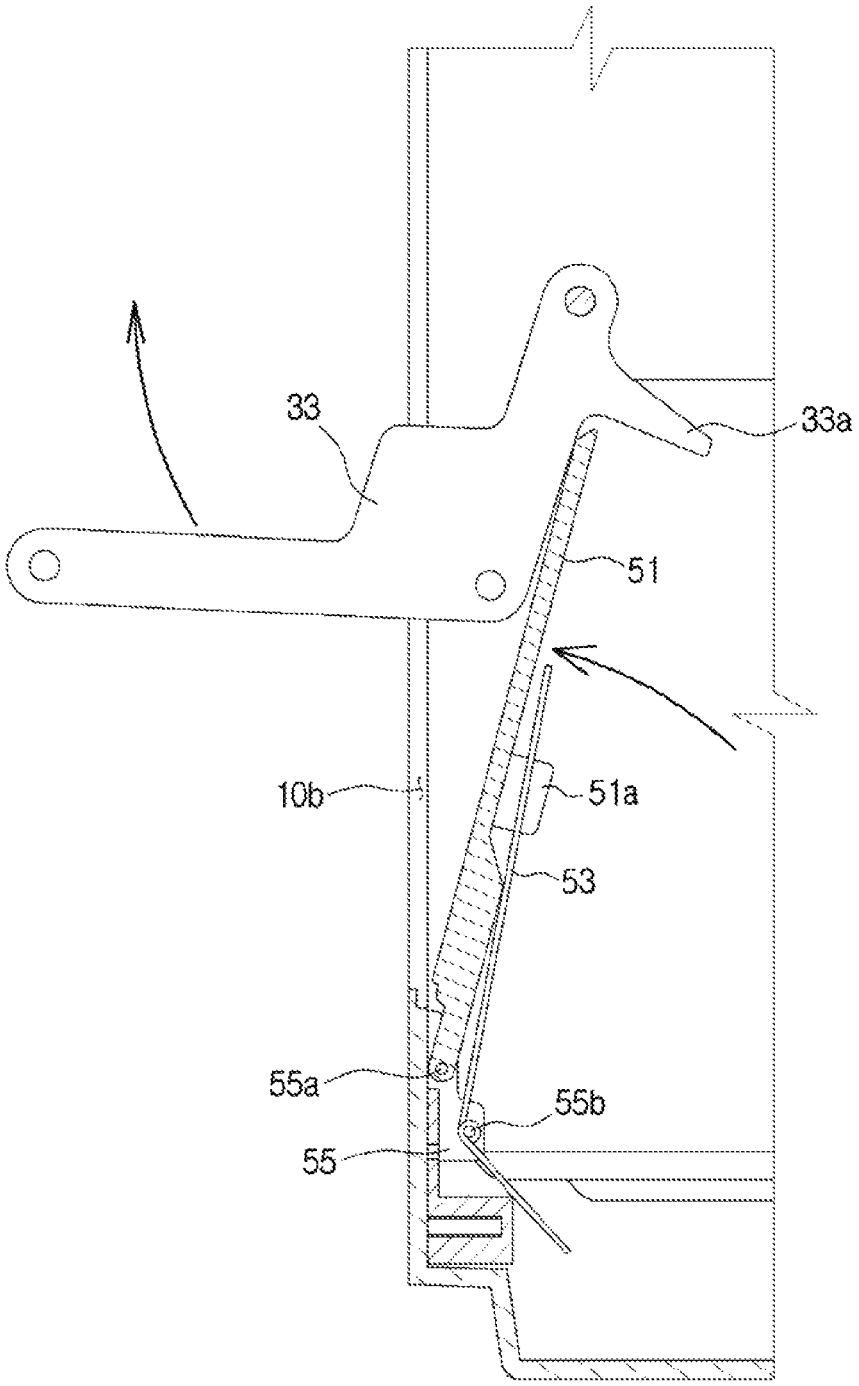
FIGS. 10, 11, and 12 are enlarged views illustrating the operation of the cover unit according to the movement of the door when viewed from line A-A' of FIG. 1.
Figure 11:
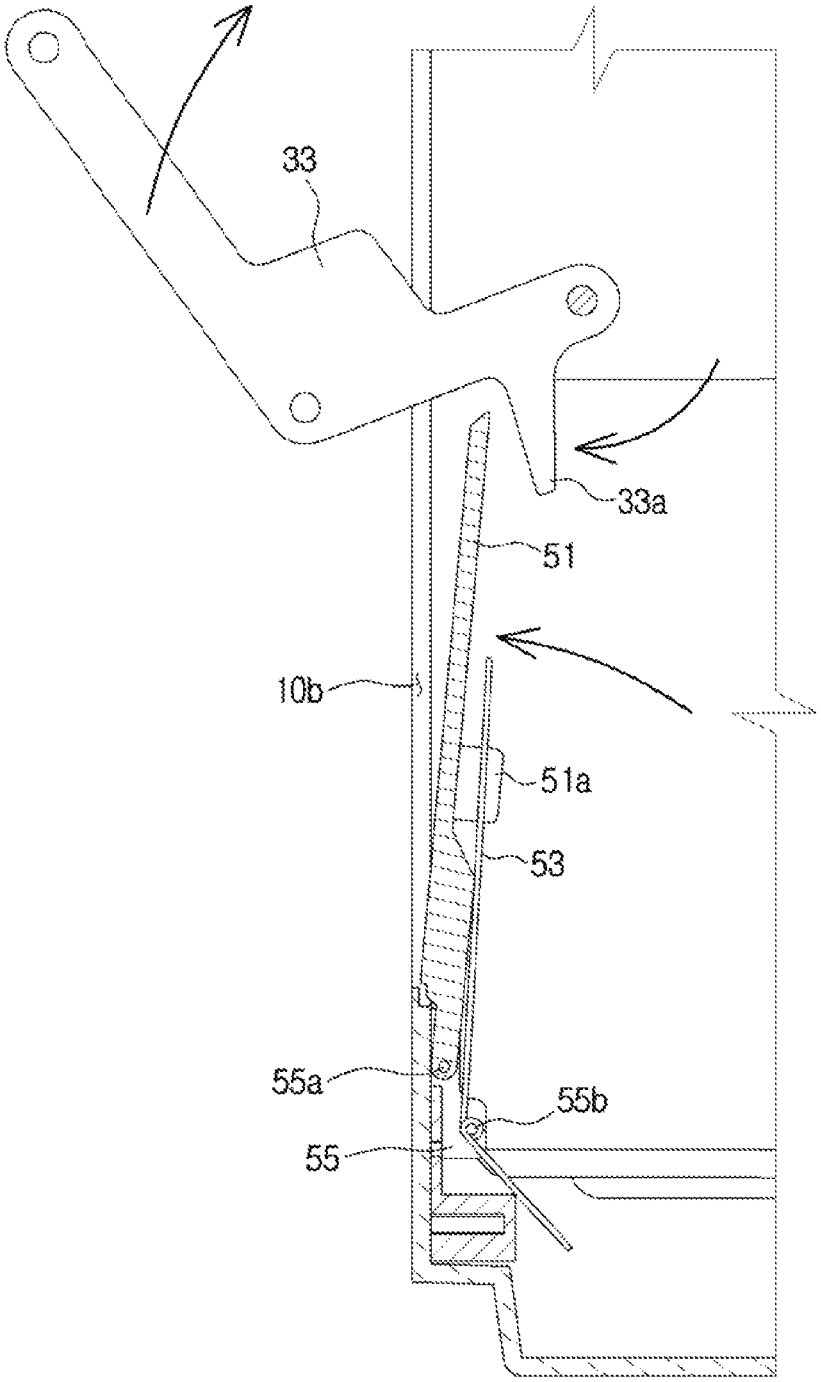
Figure 12:
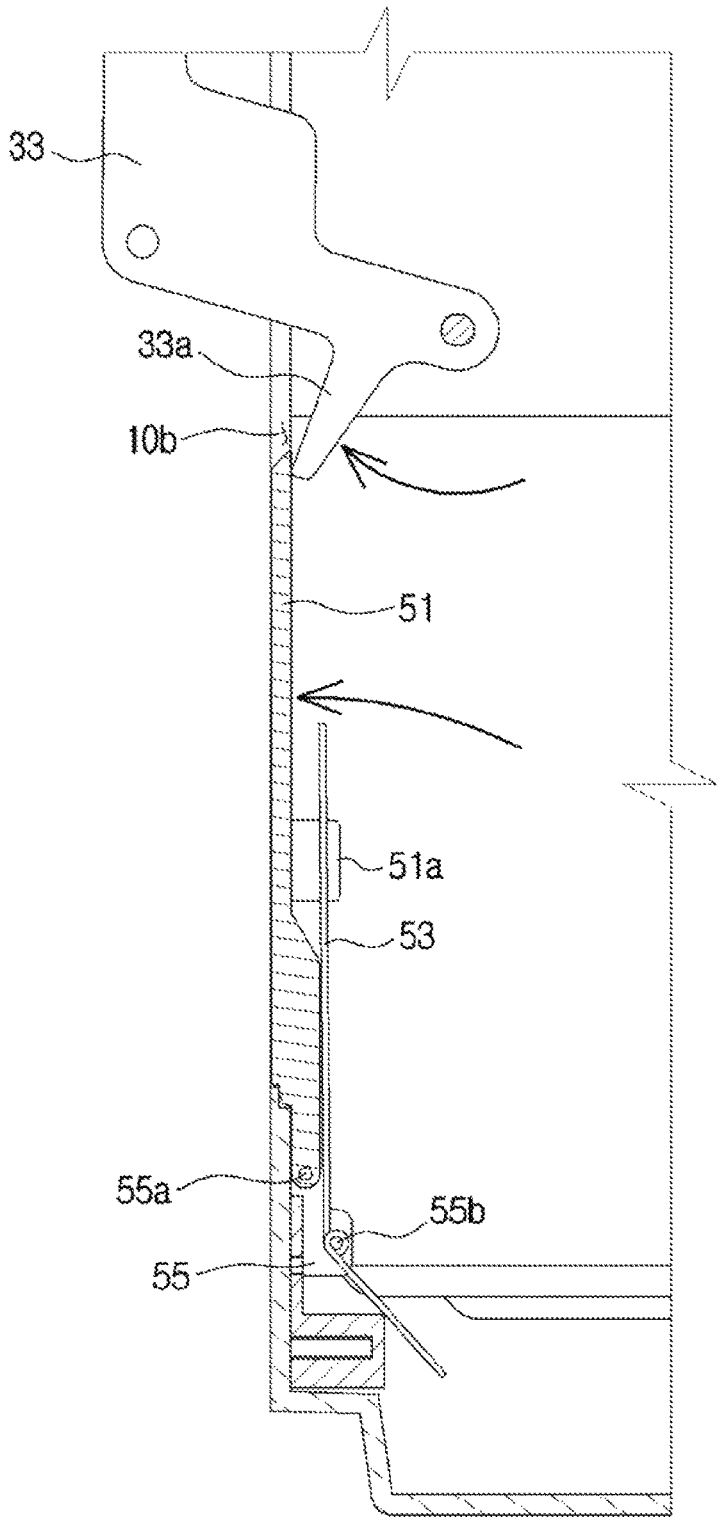

FIGS. 10 to 12 are enlarged views illustrating the operation of the cover unit according to the movement of the door when viewed from line A-A' of FIG. 1.

Referring to FIGS. 7 to 12, the first cover unit 50 may pivot according to the movement of the door 20 and may shield the link moving portion 10*b*.

As shown in FIG. 7, while the door 20 is closed, the first cover unit 50 may be disposed to be in contact with the rear side of the door moving unit 30. The cover plate 51 may be disposed while being in contact with one side of the rear side of the third link member 33 and inclined to the rear of the cooking compartment 11. Even though the cover plate 51 receives the elastic force from the first elastic member 53 to pivot toward the front of the cooking compartment 11, the cover plate 51 may remain stopped by being in contact with the third link member 33 which remains stopped. Here, the elastic force transferred from the second link member 37 to the door 20 is greater than the elastic force transferred from the first link member 53 to the cover plate 51, thereby allowing the door 20 to remain stopped.

As shown in FIGS. 8 and 10, when the door 20 is opened, the first cover unit 50 may pivot together with the door moving unit 30 to the front of the body 10. When the third link member 33 is moved outside of the body 10, due to the elastic force transferred from the first elastic member 53, the cover plate 51 may pivot toward the link moving portion 10*b*. Here, due to the elastic force transferred from the first elastic member 53, the cover plate 51 may pivot while being in contact with the rear side of the third link member 33.

As shown in FIG. 11, when the third link member 33 is moved outside of the body 10 through the link moving portion 10*b*, the cover plate 51 may pivot toward the link moving portion 10*b* due to the elastic force transferred from the first elastic member 53. Although not shown in the drawings, the cover plate 51 may be configured to have a larger cross section than that of the link moving portion 10*b* to remain stopped while shielding the link moving portion 10*b*.

As shown in FIGS. 9 and 12, when the door 20 pivots upward maximally, the first cover unit 50 may remain shielding the link moving portion 10*b*. Here, due to the elastic force transferred from the first elastic member 53, the cover plate 51 may remain shielding the link moving portion 10*b*. Also, because the fixing portion 33*a* of the third link member 33 is in contact with the rear side of the cover plate 51, the cover plate 51 may remain shielding the link moving portion 10*b*.

As is apparent from the described above, in accordance with an embodiment of the present disclosure, a pivoting radius of a door which opens and/or closes a cooking compartment is reduced, thereby efficiently using space.

Also, in accordance with an embodiment of the present disclosure, an inside of a cooking appliance may be prevented from being exposed when the door opens and/or closes while being moved upward and downward.

Also, through a simple configuration, the cooking compartment may be opened and/or closed by the door while the door is moved upward and downward.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A cooking appliance comprising:

a body including a cooking compartment and a mechanical compartment;

a door link-coupled with the body and configured to open or close the cooking compartment;

a door moving connector comprising a link member which connects the door with the body and configured to allow the door to pivot upward and downward in front of the cooking compartment; and a cover which prevents the mechanical compartment in the body from being exposed by a movement of the link member, wherein the body comprises a link moving opening formed on a front side of the body and configured to allow the link member to move into and out of the body, and wherein the cover is configured to move toward the link moving opening to shield the link moving opening when the door is opened.

2. The cooking appliance of claim 1, wherein the cover comprises a cover plate provided to open or close the link moving opening and a first elastic member which transfers an elastic force to allow the cover plate to move toward the link moving opening, and wherein the cover plate is configured to allow one side to be in contact with a rear side of the link member and to shield the link moving opening when the link member is moved outside of the body.

3. The cooking appliance of claim 2, wherein the link member comprises a fixing portion in contact with a rear side of the cover plate to allow the cover plate to be fixed while shielding the link moving opening.

4. The cooking appliance of claim 2, wherein the cover plate is pivotably coupled with one side of the front side of the body, and wherein the first elastic member is configured to transfer the elastic force in a direction in which the cover plate pivots toward the link moving opening.

5. The cooking appliance of claim 2, wherein the cover plate is moved together with the link member toward a front of the cooking appliance to shield the link moving opening when the door is opened and is moved with the link member toward a rear of the cooking appliance when the door is closed.

6. The cooking appliance of claim 1, wherein the link member comprises a first link member coupled with one side of the door and a second link member coupled with the other side of the door, and wherein the first link member and the second link member are installed at symmetrical positions with respect to the cooking compartment in the mechanical compartment.

7. The cooking appliance of claim 6, wherein the link moving opening comprises a first link moving opening in which the first link member is moved and a second link moving opening in which the second link member is moved, and wherein the cover comprises a first cover which shields the first link moving opening and a second cover which shields the second link moving opening.

8. The cooking appliance of claim 6, wherein the link member comprises:

a third link member coupled with the one side of the door with the first link member;

a fourth link member coupled with the other side of the door with the second link member;

a fifth link member which connects the first link member with the third link member to pivot together; and a sixth link member which connects the second link member with the fourth link member to pivot together.

9. The cooking appliance of claim 6, wherein the door moving connector further comprises a connecting member which connects the first link member with the second link member to allow the first link member and the second link member to pivot at the same angle.

10. The cooking appliance of claim 1, wherein the link member further comprises a first holding portion formed on one side of the link member, wherein the door moving connector further comprises a second elastic member which connects the first holding portion with a second holding portion formed in the rear of the first holding portion, and wherein the first holding portion is formed to pivot around a pivoting shaft of the link member.

11. The cooking appliance of claim 10, wherein when the door is opened, the first holding portion is moved to a position higher than the second holding portion which is fixed, and the second elastic member is provided to transfer the elastic force to the link member in a direction in which the door is moved upward.

12. A cooking appliance comprising:

a body comprising a cooking compartment formed therein;

a door coupled with the body and configured to open or close the cooking compartment;

a door moving connector comprising a link member which connects the door with the body and configured to allow the door to pivot with respect to the body; and a cover which prevents an inside of the body from being exposed by a movement of the link member, wherein the body comprises a link moving opening formed on one side of the body and configured to allow the door moving connector to move into and out of the body, and wherein the cover is configured to move toward the link moving opening to shield the link moving opening when the door is opened.

13. The cooking appliance of claim 12, wherein the door moving connector is configured to allow the door to pivot upward and downward in front of the cooking compartment.

14. The cooking appliance of claim 12, wherein the cover comprises a cover plate provided to open or close the link moving opening and a first elastic member which transfers an elastic force to allow the cover plate to move toward the link moving opening, and wherein the cover plate is configured to be installed in the rear of the door moving connector and to shield the link moving opening when the door moving connector is moved outside of the body.

15. The cooking appliance of claim 14, wherein the door moving connector comprises a fixing portion in contact with a rear side of the cover plate to allow the cover plate to be fixed while shielding the link moving opening.

16. An apparatus comprising:

a body including a cooking compartment having a first opening and a mechanical compartment having a second opening;

a door configured to open or close the first opening to provide access to the cooking compartment;

a door connector pivotably connecting the door to the body through the second opening; and a cover configured to:

move toward the second opening as the door is opened such that the cover covers at least a portion of the second opening when the door is open, and move away from the second opening as the door is closed such that the door covers the second opening when the door is closed.

17. The apparatus of claim 16, wherein the door connector is configured to pivot the door relative to the body such that the door is substantially parallel to a front of the body throughout a movement of the door from a closed position to an open position.

18. The apparatus of claim 16, wherein the cover is provided in the mechanical compartment.

* * * * *